33-253 SR
7/3/79 XR 4,159,575

United States Patent [19]

Kalmbach

[11] 4,159,575

[45] Jul. 3, 1979

[54] SIGHTING DEVICE FOR ARCHERY BOWS

[76] Inventor: Philip Kalmbach, 921 Sixth Ave. N.E., Minot, N. Dak. 58701

[21] Appl. No.: 912,411

[22] Filed: Jun. 5, 1978

[51] Int. Cl.[2] ..... F41G 1/46; F41G 1/08

[52] U.S. Cl. ..... 33/265; 33/253

[58] Field of Search ..... 33/253, 265; 124/87

[56] References Cited

U.S. PATENT DOCUMENTS

| | | | |
|---|---|---|---|
| 36,760 | 10/1862 | Allen | 33/253 |
| 1,027,891 | 5/1912 | Peck, Jr. et al. | 33/253 |
| 2,959,860 | 11/1960 | Kowalcyk | 33/265 |
| 2,998,652 | 9/1961 | Zielinski | 33/265 |
| 3,058,221 | 10/1962 | McNeel | 33/265 |
| 3,063,151 | 11/1962 | Hanson | 33/265 |
| 3,271,863 | 9/1966 | Harrington | 33/265 |

FOREIGN PATENT DOCUMENTS

| | | | |
|---|---|---|---|
| 24500 of | 1912 | United Kingdom | 33/253 |

*Primary Examiner*—Richard R. Stearns

*Attorney, Agent, or Firm*—Peterson, Palmatier, Sturm & Sjoquist, Ltd.

[57] ABSTRACT

The device includes an elongated body in the form of a metal strip that is secured to one side of an archery bow. At the rear end of the body there is a laterally extending arm on which is mounted a rotatable disc having a number of sight openings therein, the sight openings being at differing distances from the disc's axis of rotation. Detent means assures that whatever sight opening is selected remains in position, yet readily permits another sight opening to be selected for a different shooting range. At the front end of the elongated body is another laterally extending arm, this arm having a plurality of vertically oriented threaded apertures into any one of which can be threaded a pin provided with a bead or ball on its upper end. By properly selecting the particular sighting opening at the rear and by properly adjusting the height of the bead or ball at the front, the bowman is able to control quite accurately the course of the arrow.

9 Claims, 4 Drawing Figures

FIG. 1
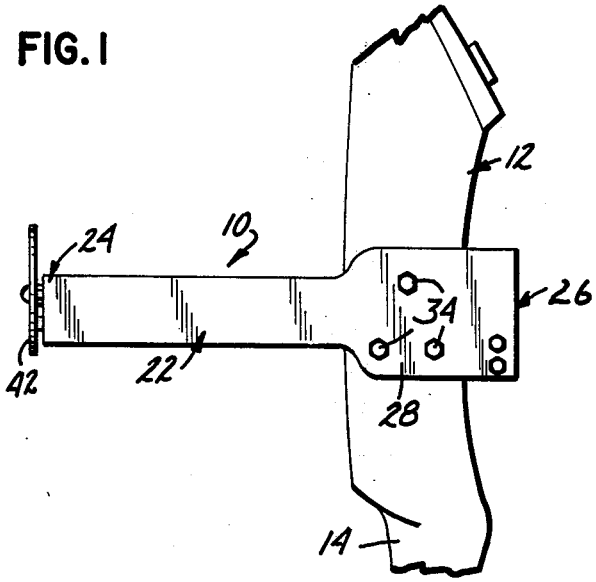
FIG. 2
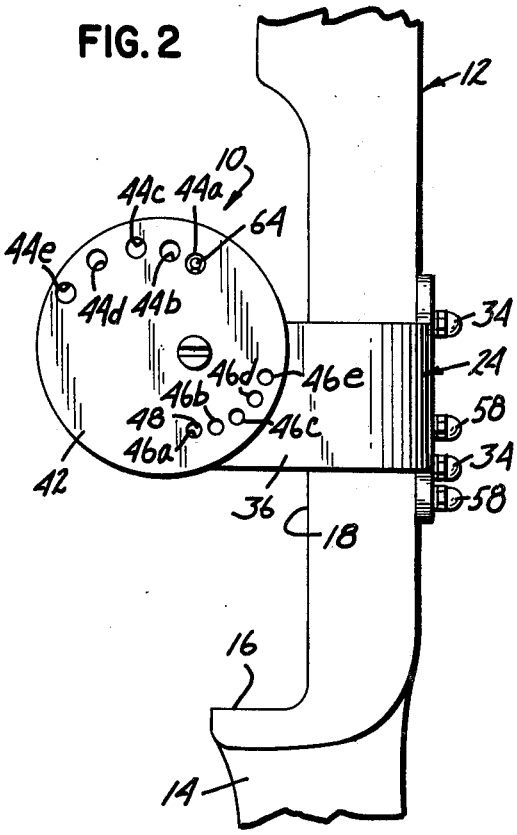
FIG. 4
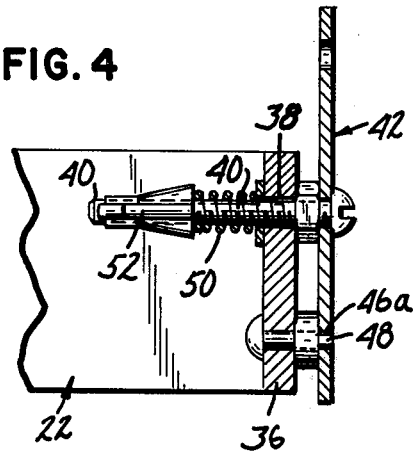
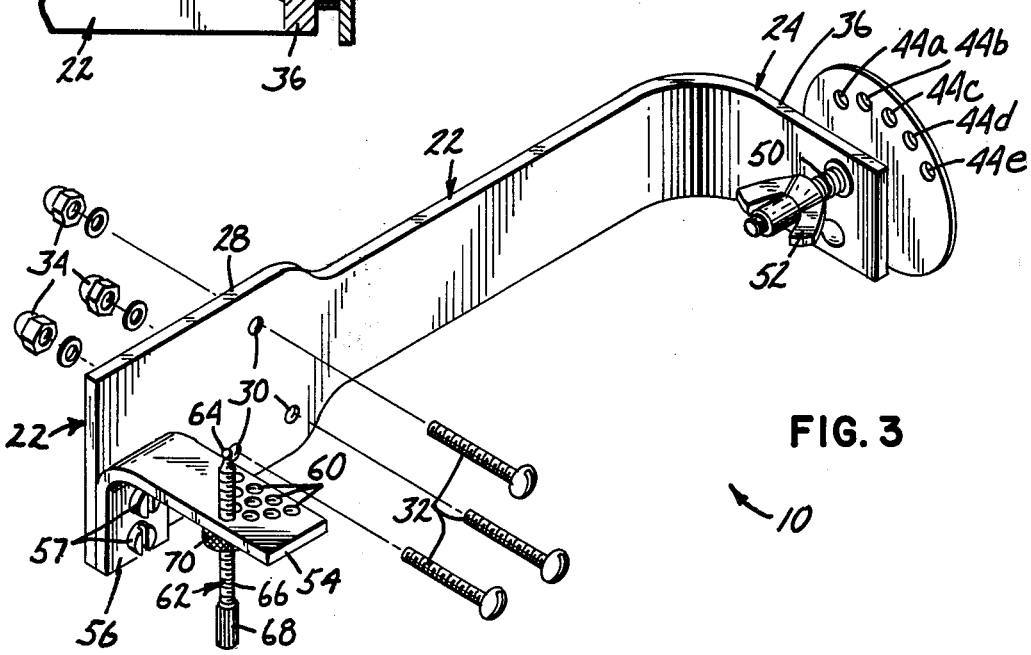
FIG. 3

SIGHTING DEVICE FOR ARCHERY BOWS

BACKGROUND OF THE INVENTION

1. Field of the Invention

This invention relates generally to archery bows, and pertains more particularly to an adjustable sighting device therefor.

2. Description of the Prior Art

Various bow sights have been contrived in the past for the purpose of improving the accuracy with which an archer shoots an arrow. Some of these bow sights have been permanently incorporated into the bow itself. Others function as attachments. Obviously, where the device is intended primarily for target practice, the need for a rapidly achieved adjustment is not too important, although the need for precision is obviously present. However, where a bowman engages principally in hunting, it is imperative that the particular sighting device he is using be adjusted quickly as well as accurately. Otherwise, his quarry is apt to escape. Hence, there are various shortcomings as far as prior art sighting devices are concerned.

SUMMARY OF THE INVENTION

Accordingly, one object of the present invention is to provide a sighting device for achery bows that will be found useful by archers who hunt and/or engage in target practice.

Another object of the invention is to virtually eliminate guesswork in the precise aiming of an arrow.

A further object of the invention is to enable my device to be adjusted rapidly for different shooting distances.

A further object is to provide a bow sighting device which is lightweight, easily mounted on any bow, and which is also aesthetically attractive.

Yet another object of the invention is to provide a bow sight that is inexpensive to manufacture, rugged and long-lasting.

Briefly, my invention envisages an elongated body of strip material which is secured to one side of a conventional bow. Integral with the rear end of the elongated body is a laterally directed arm upon which is mounted a rear sight. More specifically, the rear sight comprises a shaft rotatably carried by the rear arm, the shaft having mounted thereon a disc provided with a number of sight openings located at differing distances from the disc's axis of rotation. A smaller set of detent openings in the disc coact with a detent pin mounted on the rear arm so as to maintain the selected sight opening in its selected position. At the forward end of the elongated body is another laterally extending arm, this arm having a number of threaded vertical apertures so that a sighting pin can be threaded into a selected aperture and adjusted vertically so that the bead or ball at its upper end can be initially positioned with respect to a first sighting opening at the rear. The threaded apertures are at different distances from the rear disc and also at slightly different angles with respect thereto by reason of being at different locations along the forwardly disposed arm.

BRIEF DESCRIPTION OF THE DRAWING

FIG. 1 is a side elevational view of my sighting device when mounted on a conventional bow, the bow being only fragmentarily depicted;

FIG. 2 is a rear elevational view looking forward in the direction an arrow travels, the bead on the front sighting pin being visible through the sight opening used in initially adjusting my bow sighting device;

FIG. 3 is a perspective view of my device prior to being attached to the bow of FIGS. 1 and 2, and FIG. 4 is a vertical sectional view taken through the axis about which the disc rotates and also through the detent pin which prevents inadvertent rotation of the disc.

DESCRIPTION OF THE PREFERRED EMBODIMENT

Inasmuch as my sighting device 10 can be used with virtually any type of conventional bow, only a portion of a bow 12 has been depicted in FIGS. 1 and 2. As a practical matter, however, it can be stated that my sighting device 10 has been attached to a compound bow, and has performed very successfully thereon. As is generally known, compound bows utilize rather elaborate pulley and cable systems for the purpose of achieving an optimum drawstring tension, especially under full draw conditions. The complexity of such pulley-cable systems militates against the showing of a complete bow. At any rate, the fragmentarily shown bow 12 includes a handle portion 14, an arrow rest 16 immediately above and a sighting window 18 curving upwardly from the arrow rest.

The device 10 includes an elongated body 22 in the form of a metal strip. For the sake of description, the rear end of the elongated body 22 will be given the reference numeral 24 and its forward end the reference numeral 26. Extending rearwardly from the forward end 26 is a mounting panel 28 having several holes 30 formed therein. Three bolts 32 are used to fasten the device to the bow 12. These bolts 32 extend through the holes 30 and the frame portion of the bow adjacent the sighting window 18, nuts and washers at 34 holding the device 10 in place. As can be seen from FIGS. 1 and 2, the sighting device 10 in the illustrative situation is attached to the right side of the bow 12.

At the rear end 24 is an integral arm 36 which extends laterally from the body 22 at this end. The arm 36 is formed with an untapped hole 38 in which is journaled a threaded shaft 40.

Mounted on the threaded shaft 40 is a circular disc 42 having five sight openings **44*a*, 44*b*, 44*c*, 44*d* and 44*e* formed therein. The openings 44 are spaced at varying distances with respect to the axis of rotation of the shaft 40. Stated somewhat differently, the hole pattern for the sight openings 44 is what might be best described as constituting a segment of an involute. More will be said presently concerning the role played by these openings 44**.

Angularly oriented beneath the sight openings **44*a*, 44*b*, 44*c*, 44*d* and 44*e* are five detent holes 46*a*, 46*b*, 46*c*, 46*c* and 46*e*, respectively. By means of a detent pin 48 projecting rearwardly from the arm 36 whatever sight opening 44 is selected by rotating the disc 42 will be retained in its selected position by reason of the engagement of the detent pin 48 in the particular detent hole associated therewith. In other words, the detent holes 46*a*, 46*b*, 46*c*, 46*d* and 46*e* are angularly aligned with the sight openings 44*a*, 44*b*, 44*c*, 44*d* and 44*e*, respectively, so that whatever sight opening 44** is vertically thereabove will be retained in that selected position.

Assisting in the holding of the disc 42 in an adjusted position is a coil spring 50 that encircles the threaded shaft 40. A wing nut 52 threaded on the shaft can be tightened to whatever degree is needed in order to pull the shaft 40 forwardly so that the detent pin 48 extends into the appropriate detent hole 46. Sufficient tightening of the wing nut 52 can completely compress the spring 50, and for all intents and purposes positively retain the disc 42 in its adjusted position. However, when the nut 52 has not been tightened to any extent, the disc 42 can be manually pulled rearwardly to overcome the biasing action of the spring 50, thereby causing the particular detent hole 46 to move sufficiently rearwardly from the end of the detent pin 48 so that the disc 42 is released and can be rotatably adjusted to bring a different opening 40 into the bowman's line of sight.

At the forward end 26 is another laterally extending arm 54, this arm residing in a generally horizontal plane in contradistinction to the generally vertical plane in which the rear arm 36 lies. The arm 54 has a mounting flange 56 which is attached to the panel 28 by means of a pair of screws 57 and nuts 58. The arm 54 and its flange 56 constitute an L-shaped member.

From FIG. 3 it will be seen that the arm 54 has a plurality of vertically oriented tapped or threaded apertures 60 formed therein. Some of the apertures 60 are at different distances from the rear disc 42 and others are at different distances from the forward end 26 of the elongated body 22.

A sighting pin 62 can be located in any one of the tapped apertures 60. The sighting pin 62 comprises a bead or ball 64 at the top, a threaded intermediate shank 66 and a bottom knurled knob 68, the knob 68 enabling the pin to be rotated so that its bead or ball 64 can be raised or lowered so as to position the bead or ball relative to the various sight openings in the circular disc 42 at the rear. A jam nut 70 is threaded and carried on the shank 66 and when tightened against the underside of the arm 54 retains the sighting pin 62 in whatever adjusted condition it has been placed.

Inasmuch as my sighting device 10 can be attached to virtually any conventional bow, it should be pointed out that initially the elongated body 22 can be clamped to the side of the bow 12 in order to establish an initial datum or preliminary alignment as far as the intended line of sight for the shortest shooting distance that is expected. This can be readily done by using two small C-clamps (not shown). After clamping the device 10 to the bow 12 in the approximately correct position, then the disc 42 is rotatably adjusted so as to position the sight opening **44*a*, this being the opening nearest the axis of rotation, into view. Then the sighting pin 62 is rotated to raise or lower, as the case may be, the front bead 64 in order to cause it to appear at the center of the sight opening 44*a***, this procedure being followed, say, when aiming an arrow at a bull's-eye fifteen yards away.

After accomplishing the foregoing, then my sighting device 10 can be permanently fastened to the bow 12 by means of the several bolts 32 and nuts 34. Of course, to do this, holes must first be drilled through the bow 12 at the proper locations and the bolts 32 inserted therethrough.

Quite obviously, the front bead 64, which has been adjusted as outlined above, will remain in the same position for shooting any distance from the nearest distance, which has been suggested as being fifteen yards, to the greatest distance which is typically fifty-five yards. If desired, however, the sighting pin can be shifted to one of the other threaded apertures 60, in order to improve the azimuth correction. In other words, the arrow to be shot should be parallel, both horizontally and vertically, to the line of sight as determined by the rear and front sight adjustments. A range of from fifteen to fifty-five yards, it can be mentioned, is considered to be the maximum range normally expected for which most shooting, either at a target or at game, will be done.

Inasmuch as five sight openings 44 are provided, this number provides settings approximating ten yard intervals, starting with the previously mentioned fifteen yards. Thus, with the sight opening **44*a* selected, then the previously mentioned range of fifteen yards will be realized. On the other hand, with the sight opening 44*b* selected and moved into position above the axis about which the disc 42 is rotated, then a range of twenty-five yards will be adjusted for. The next opening 44*c* will provide thirty-five yards, the succeeding opening 44*d* forty-five, and the remaining opening 44*e*, which is located the greatest distance from the shaft 64** or axis of disc rotation, will provide a fifty-five yard range.

It will be appreciated that once the initial or minimum shooting distance is adjusted for, then the archer can readily readjust the device 10 to obtain the other shooting distances. All he need do is pull the disc 42 sufficiently rearwardly, compressing the coil spring 50 in the process, to disengage the detent hole **46*a* from the detent pin 48. He can then rotate the disc 42, while retracted, to bring whatever sight opening 44*b*, 44*c*, 44*d* or 44*e* into view. Release of the disc 42 will cause the detent pin 48 to engage in the particular detent hole 46*b*, 46*c*, 46*d* or 46*e*** that is then in alignment.

It is expected that there will be slight variations with respect to the different distances that should be adjusted for, depending largely on the kind of arrow, the pound rating of the bow, the weight of the arrows, and the manner in which the archer releases the bowstring. However, while these are initial variables, they can readily be accounted for as far as a given situation is concerned. Consequently, my sighting device enables the bow, once initially adjusted, to be aimed at a target at different distances. When the target is a swiftly moving animal, it is imperative that the readjustment by the hunter be rapidly achieved. This can be accomplished by simply pulling the disc 42 rearwardly and angularly shifting the sight openings 44 so as to bring the most appropriate opening into alignment between the archer's eye and the bead or ball 64. With the front bead 64 seen in the center of the particular rear sight opening 44 that has been selected, the arrow will be properly aimed and will hit the desired target with a high degree of precision, whether stationary or moving.

Of course, if it is planned that the distance or range will always be the same, the user can elect to tighten the wing nut 52 sufficiently so that the coil spring 50 is fully compressed; this will firmly anchor the disc 42 to such an extent that it will be for all intents and purposes fixedly mounted and will not vibrate or make any noise when the arrow is released.

It will be understood, it is believed, that while the sighting pin 62 has been shown positioned in a central and most forward tapped aperture 60, any of the various threaded apertures 60 can be selected, however, to take care of horizontal or azimuth angles. In this regard, the most appropriate position for the sighting pin 62 will be influenced largely by the manner in which the bow 12 is held by a particular archer. The point to be made is that the bowman does have an initial choice as far as any horizontal adjustment is concerned, this being in addition to the precise vertical adjustment that is made possible by adjusting the rear disc 42 and by adjusting the forwardly disposed sighting pin 62. Stated somewhat differently, by using a tapped aperture 60 to either side of that in which the sighting pin 62 has been shown will introduce a small horizontal angular correction that can be relied upon to make the line of sight parallel to the arrow and its intended flight path.

It will be recognized that the sighting device 10, as illustrated, is for a right-handed shooter. For a left-handed shooter the arms 36 and 54 would extend in opposite directions.

I claim:

1. A sighting device for archery bows comprising an elongated body adapted to be attached intermediate its ends to one side of a bow, first and second arms extending laterally from the opposite ends of said body, first sighting means carried on said first arm including a member having a sight opening therein, and second sighting means carried on said second arm including a sighting pin, said member constituting a disc mounted on said first arm for rotation about an axis provided by said first arm.

2. A sighting device in accordance with claim 1 in which said disc has additional sight openings angularly spaced from said first sight opening and located at different distances from said axis.

3. A sighting device in accordance with claim 2 including detent means for resisting rotation of said disc to maintain any given sight opening in its selected position.

4. A sighting device in accordance with claim 3 in which said detent means includes a pin mounted on and projecting from said first arm, said disc having a number of holes angularly oriented with respect to said sight openings for receiving said pin therein to maintain any given sight opening in its selected position.

5. A sighting device in accordance with claim 4 including a shaft projecting from one side of said disc, said first arm having a hole for rotatably journaling said shaft therein to provide said axis about which said disc can be adjustably rotated.

6. A sighting device in accordance with claim 5 including a coil spring encircling said shaft, said shaft having a threaded shank, and a wing nut threaded onto said threaded shank for compressing said spring to vary the force with which said disc is pulled to cause engagement of said detent pin in one of said detent holes.

7. A sighting device in accordance with claim 2 in which said second sighting means includes an upstanding pin.

8. A sighting device in accordance with claim 7 in which said pin includes a threaded shank and a ball at the upper end thereof, said second arm having a tapped aperture for threadedly engaging said shank so that said ball can be adjusted vertically.

9. A sighting device in accordance with claim 8 in which said second arm has a number of additional tapped apertures located in said second arm at different distances from said elongated body and at different distances from said disc so that said pin can be threadedly engaged in any one of said tapped apertures.

* * * * *